United States Patent [19]

Wu

[11] Patent Number: 4,838,290

[45] Date of Patent: Jun. 13, 1989

[54] SLIMLY-FOLDED UMBRELLA HAVING EXTENDIBLE BRIM PORTION

[76] Inventor: Tsun-Zong Wu, P.O. Box 10160, Taipei, Taiwan

[21] Appl. No.: 200,566

[22] Filed: May 31, 1988

[51] Int. Cl.[4] ..... A45B 21/00

[52] U.S. Cl. ..... 135/25 R; 135/16; 135/35 S

[58] Field of Search ..... 135/25 R, 35 S, 35 V, 135/20 M, 16

[56] References Cited

U.S. PATENT DOCUMENTS

| | | | |
|---|---|---|---|
| 100,012 | 2/1870 | Caldwell | 135/25 R |
| 1,103,799 | 7/1914 | McMillan | 135/25 R |
| 2,841,160 | 7/1958 | De Wispelere | 135/35 S |
| 3,726,295 | 4/1973 | Diaz | 135/25 R |
| 4,597,400 | 7/1986 | Trudeau | 135/18 |
| 4,641,675 | 2/1987 | Wu | 135/16 |
| 4,760,610 | 8/1988 | Wu | 135/16 |

FOREIGN PATENT DOCUMENTS

| | | | |
|---|---|---|---|
| 473750 | 3/1929 | Fed. Rep. of Germany | 135/35 S |
| 645789 | 10/1984 | Switzerland | 135/25 R |
| 1378272 | 12/1974 | United Kingdom | 135/25 R |

*Primary Examiner*—Henry E. Raduazo

[57] ABSTRACT

An umbrella includes a plurality of main links for securing an umbrella cloth and several shortened links each pivotally connected with a tail link which is operatively suspended horizontally to a stretcher link by a supporting link when opening an umbrella so that tail links with the secured umbrella cloth may be flattened horizontally to serve as a brim for shielding purpose without obstructing a user's sight. The tail links are folded to be linearly aligned with the shortened links to form a slim linkage of an umbrella for convenient handling or storage.

7 Claims, 4 Drawing Sheets

SLIMLY-FOLDED UMBRELLA HAVING EXTENDIBLE BRIM PORTION

BACKGROUND OF THE INVENTION

David L. Trudeau disclosed an Umbrella having the appearance of a conventional unbrella extended to open in the form of a baseball hat in his U.S. Pat. No. 4,597,400, which however may not fully shield a user's shoulders because the lower spreaders 62, 64 pivotally mounted on a sleeve 56 may obstruct a user's head and shoulders, unable to poke into a bell-shaped crown 12.

By modifying the Trudeau's umbrella in view of Caldwell's U.S. Pat. No. 100,012 for poking a users head into the bell-shaped crown or dome, the umbrella will not be foldable with respect to an illustration as shown in FIG. 2 which is inferentially expected from FIG. 1.

As shown in FIG. 1, the Caldwell's umbrella of U.S. Pat. No. 100,012 may be folded by a parallelogram defined by links B, F, E, C and may be extended to have a pose of a tilting end bow F which would be vulnerable to receive a strong wind force especially when walking in a storm, resulting in a difficult walking and heavier holding of the umbrella.

If by inferentially modifying Caldwell's umbrella (U.S. Pat. No. 100,012) to have a flat brim as shown in full line of FIG. 2, the flat brim may aerodynamically reduce the air resistance on the umbrella hood or crown so that the modified umbrella can be easily carried by a user walking in a storm. Nevertheless, the flat brim of Caldwell's device would not be foldable as shown in the dotted line of FIG. 2 since the rotative folding of the end bow F around a fulcrum P requires a larger radius r1 which however is limited by the small radius r2 near the stretcher link C.

The present inventor has found the drawbacks of a conventional umbrella and invented the present slimly-folded umbrella having extendible brim portion.

SUMMARY OF THE INVENTION

The object of the present invention is to provide an umbrella having several main links, securing an umbrella hood or cloth thereon and being shortened to pivotally connect several tail links, the tail links being operatively extendible to form a flat brim above a user's visual level when opening the umbrella, and foldable to become a slim linkage when closing the umbrella so that the umbrella can be opened to have a clear sight under the flat brim, and can be closed to have a slim structure for convenient handling and storage.

DETAILED DESCRIPTION

Figure 1:
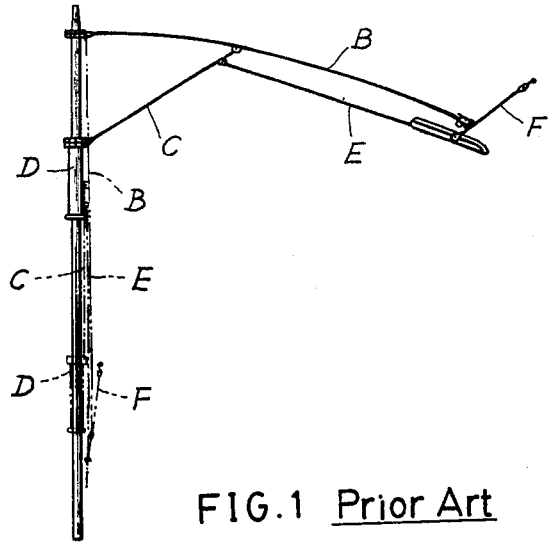
FIG.1 Prior Art
FIG. 1 is a prior art of a conventional umbrella.
Figure 2:
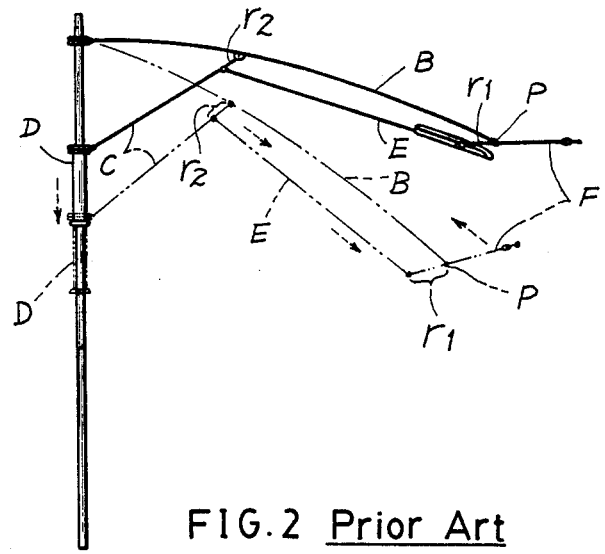
FIG.2 Prior Art
FIG. 2 is a modification inferentially made from the umbrella as shown in FIG. 1.

As shown in FIGS. 3–8, the present invention comprises: a plurality of main links 1 securing an umbrella hook or cloth 7 thereon and generally occupying an area larger than half a circle of the umbrella hood 7 when projectively viewed from a top view of the hood, each main link 1 radially disposing around an axis 60 of a central shaft 6 having an inner end 11 pivotally secured to an upper notch 61 formed on an upper portion of the shaft 8 and having an outer end 12 secured with an outer periphery of the umbrella hood 7; a plurality of stretcher links 2 each link 2 having an inner end 21 pivotally secured to a lower runner 62 slidably mounted on the shaft 6 and having an outer end 22 pivotally secured to a middle portion 13 of each main link 1; a plurality of shortened main links 3 securing a remaining hood portion of the umbrella hood 7 majorly secured by the main links 1, each shortened main link 3 radially disposing around the axis 60 of the shaft 6 and generally having a U-shaped cross section having an inner end 35 pivotally secured to the upper notch 61 of the shaft 6 and having a middle portion 36 pivotally secured with an outer end 22 of each stretcher link 2, and having an outer portion 30 formed as a bifurcate plate protruding downwardly from a lower edge 34 of a base plate 33 of the link 3; a plurality of tail links 4 each link 4 having an outer end 43 secured with an outer periphery of hood 7 and having an inner portion 40 generally formed as a U-shaped cross section having an innermost end 41 pivotally connected by a pin 411 with an outermost end 31 of each shortened main link 3 and having a pair of lugs 42 formed on an inner portion 40 proximate to the innermost end 41 of the link 4 pivotally connected to an outermost end 51 of a supporting link 5 by a pin 421; and a plurality of the supporting links 5 each link 5 having its inner end 52 pivotally secured to an outer portion 23 of the stretcher link 2 proximate to the outermost end 22 of the link 2.

Figure 3:
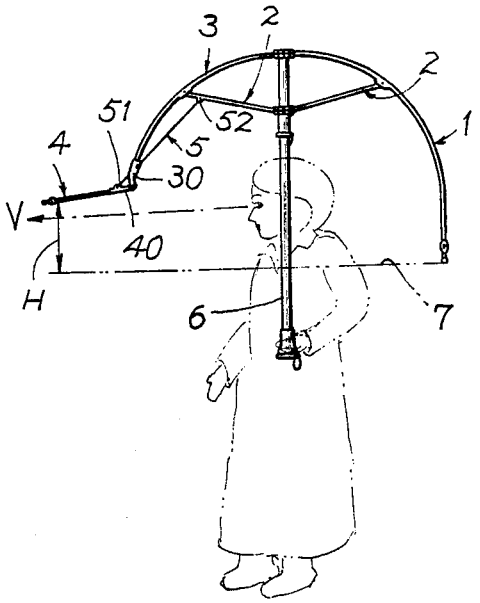
FIG. 3 is an illustration showing an application of the present invention.
Figure 5:
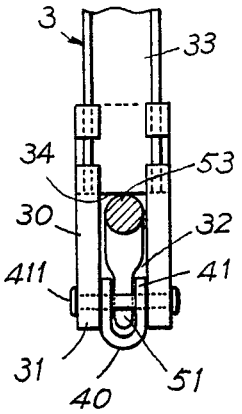
FIG. 5 is a side view showing a connection of several links of the present invention when viewed from direction A of FIG. 4.
Figure 4:
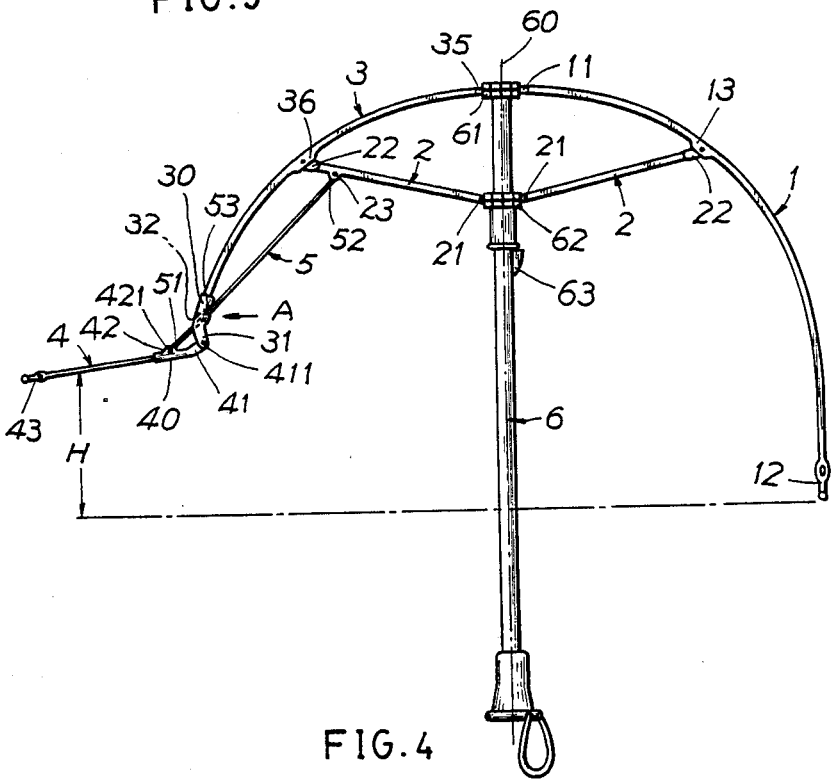
FIG. 4 is an illustration showing an extended umbrella of the present invention.
Figure 6:
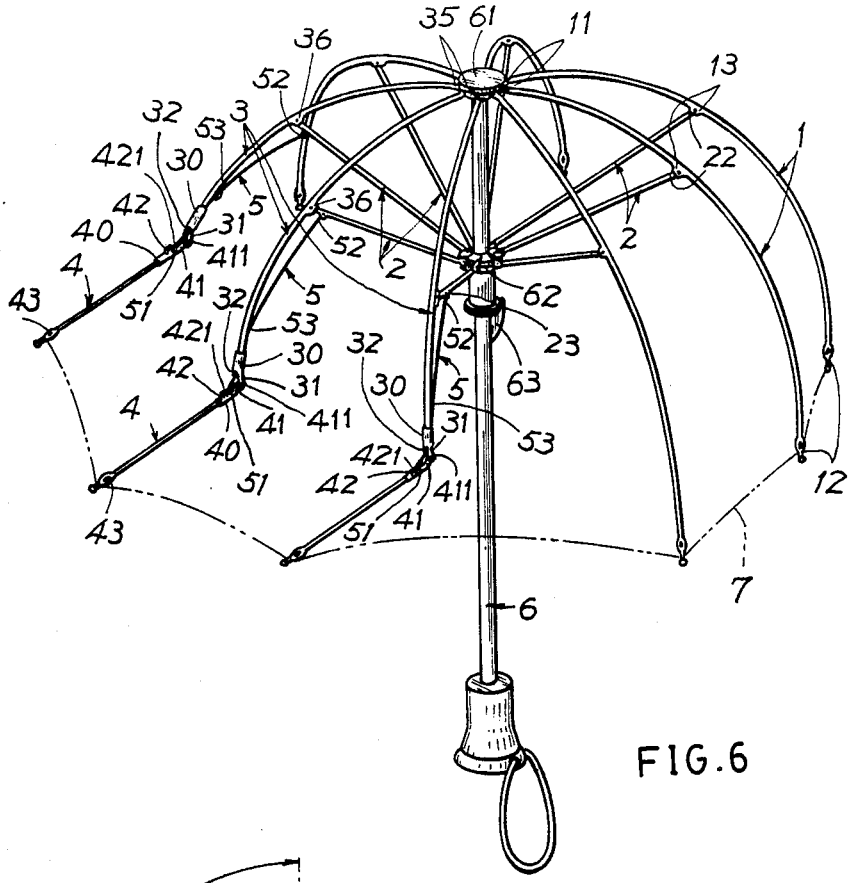
FIG. 6 is a perspective view of the present invention when extended.

The supporting link 5 has its outer portion 53 protruding outwardly through a longitudinal slot 32 defined in the bifurcate plate of the outer portion 30 of the shortened link 3, retaining against a lower edge 34 of the base plate 33 of the shortened link 3, to pivotally connect the inner portion 40 of the tail link 4 to form a generally X-shaped configuration defined among the shortened link 3, the supporting link 5 crossing the shortened link 3, the upper stretcher link 3 and the lower tail link 4, and to suspend the tail link 4 to be generally horizontal having a height H above a periphery defined by the outer ends 12 of the main links 1, when raising the lower runner 62 upwardly to be locked by a locker plate 63 resiliently held in the shaft 6 as shown in FIG. 4. The height H is defined between the horizontal tail link 4 slightly higher than a user's visual level V, and the periphery of the outer ends 12 of the main links 1 generally lower than a user's shoulder. The tail links 4 as suspended horizontally may serve as a brim for shielding rain or snow without obstructing a user's sight as shown in FIG. 3.

Figure 8:
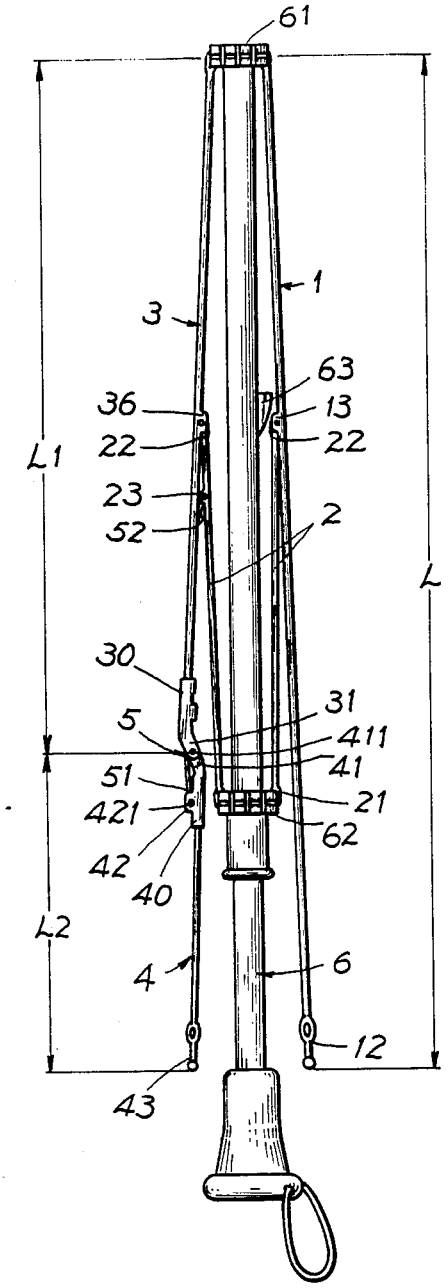
FIG. 8 shows a folded umbrella in accordance with the present invention.

A length L1 of each shortened link 3 plus a length L2 of each tail link 4 should be equal to a length L of each main link 1 so that when folding all the links of the present invention as shown in FIG. 8, a slim linkage is present for convenient handling or storage.

Figure 7:
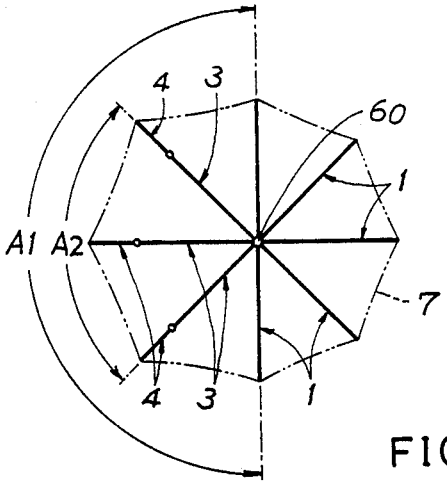
FIG. 7 is a top-view illustration of the present invention when extended.

The number of the shortened links 3 and tail links 4 are not limited in this invention. A preferred embodiment as shown in the figures shows five main links 1 and three shortened links 3. From a top view of the umbrella as shown in FIG. 7, the radial distribution or disposing of the main links 1 of a top view thereof may occupy an area generally equal to or larger than half a circle of the umbrella hood 7, whereas the shortened links 3 pivotally connected with the tail links 4 may occupy an area of half a circle of an umbrella for a visual angle of 180° (A1) or less than half a circle of the umbrella hood 7, such as 90° visual angle (A2) from a top view of the hood 7.

The umbrella hood or cloth 7 of this invention may be formed as a bell shape, a dome, or any other shapes for a foldable umbrella or an automatic umbrella.

The present invention is superior to any conventional umbrella having brim portion, with the following advantages:

1. The tail links 4 pivotally secured on the shortened links 3 can be horizontally extended to serve as a cap brim without obstructing a user's front sight.

2. The front tail links once flattened may provide a user's clear vision, but the remaining main links 1 covered with umbrella cloth still well shield the user's shoulders and neck portion, especially helpful for the user walking in a storm weather (The flat tail link 4 is higher than a lowest periphery of the main links 1).

3. Once folding the umbrella links as shown in FIG. 8, each rail link 4 is linearly aligned with each shortened link 3 and each supporting link 5 is snugly received in the U-shaped link 3, forming a slim structure for better appearance and convenient handling.

I claim:

1. An umbrella comprising:

a plurality of main links securing an umbrella hood or cloth thereon, each said main link having an inner end pivotally secured to an upper notch formed on an upper portion of a central shaft and having an outer end secured to a lower periphery of the umbrella hood, the main links radially disposed around said shaft generally occupying an area larger than half a circle of the umbrella hood from a top view of the hood;

a plurality of stretcher links each stretcher link having an inner end pivotally secured to a lower runner slidably mounted on the central shaft and having an outer end pivotally secured to a middle portion of said main link;

a plurality of shortened main links securing a remaining hood portion of the umbrella hood and generally occupying an area less than half a circle of the umbrella hood from a top view of the hood, each shortened main link having an inner end pivotally secured to said upper notch and having a middle portion pivotally secured to an outermost end of said stretcher link;

a plurality of tail links each tail link having an innermost end pivotally secured to an outermost end of each said shortened main link and having an outer end secured with a lower periphery of said hood; and a plurality of supporting links each supporting link having an outer portion protruding outwardly through a slot formed in an outer portion of each said shortened main link to pivotally connect an inner portion of a tail link proximate to the innermost end of the tail link, and having an inner end pivotally secured to an outer portion of said stretcher link proximate to the outermost end of said stretcher link;

each said supporting link crossly protruding through said shortened main link to horizontally suspend each said tail link to operatively form a generally X-shaped configuration by said shortened link, said supporting link crossing said shortened link, an upper stretcher link and a lower horizontal tail link when opening the umbrella, said horizontal tail link being flattened to serve as a brim and being higher than a periphery of said outer ends of said main links.

2. An umbrella according to claim 1, the tail link once being suspended horizontally, has a height defined between the horizontal tail link slightly higher than a user's visual level, and the periphery of the outer ends of the main links generally lower than a user's shoulder so that a user's shoulder and neck portion can be shielded by said hood secured on said main links and a user's sight is not obstructed as the tail links secured with a lower periphery of the hood being flattened horizontally to be above a user's sight.

3. An umbrella according to claim 1, wherein a length of said shortened main link plus a length of said tail link equals to a length of said main link so that upon a folding of the umbrella, a slim linkage is formed.

4. An umbrella according to claim 1, wherein said umbrella hood or cloth is formed as a bell shape or a dome, having a brim portion operatively formed by said tail links.

5. An umbrella according to claim 1, wherein five main links and three shortened main links are provided in construction of an umbrella.

6. An umbrella according to claim 1, wherein said shortened main link is generally formed as a U-shaped cross section having a lower outer portion formed as a bifurcate plate from a lower edge of a base plate of said shortened link, said bifurcate plate defining a slot for crossly protruding the outer portion of said supporting link to retain against the lower edge of said shortened link when opening the umbrella, said U-shaped cross section of said shortened link snugly receiving said supporting link therein when folding the umbrella.

7. An umbrella according to claim 1, wherein said tail link has an inner portion generally formed as a U-shaped cross section having a pair of lugs protruding from said inner portion, proximate to the innermost end of said tail link, for pivotally connecting an outermost end of said supporting link.

* * * * *